US005385241A

United States Patent [19]

Bokor

[11] Patent Number: 5,385,241

[45] Date of Patent: Jan. 31, 1995

[54] TENSION SCREEN

[75] Inventor: Anton Bokor, Stutensee, Germany

[73] Assignee: Western Wire Works Inc., Portland, Oreg.

[21] Appl. No.: 67,468

[22] Filed: May 25, 1993

[30] Foreign Application Priority Data

Jan. 8, 1993 [DE] Germany ..... 4300303

[51] Int. Cl.[6] ..... B07B 1/49

[52] U.S. Cl. ..... 209/399; 209/405

[58] Field of Search ..... 209/395, 399, 403, 405, 209/409

[56] References Cited

U.S. PATENT DOCUMENTS 3,684,091 8/1972 Wehner ..... 209/399 X
4,120,784 10/1978 Hassall ..... 209/399
4,486,302 12/1984 Jorgensen ..... 209/399
5,104,521 4/1992 Rutherford ..... 209/399

FOREIGN PATENT DOCUMENTS 2303913 8/1973 Germany ..... 209/399
2461237 7/1976 Germany ..... 209/399
2932696 2/1981 Germany ..... 209/399

*Primary Examiner*—D. Glenn Dayoan
*Attorney, Agent, or Firm*—Marger, Johnson, McCollom & Stolowitz

[57] ABSTRACT

This invention concerns a tension screen with a screen area including screen linings stretched over machine-mounted crossbars with a camber, where the screen linings have a plastic wear layer with screen passages and wire tension cables that run across the crossbars and are braced on the machine by connecting elements at the ends.

26 Claims, 4 Drawing Sheets

TENSION SCREEN

BACKGROUND OF THE INVENTION

This invention concerns a tension screen with a screen area consisting of screen linings stretched over machine-mounted crossbars with a camber, where the screen linings have a plastic wear layer with screen passages and wire tension cables that run across the crossbars and are braced on the machine by means of connecting elements at the ends.

Tension screens of the aforementioned type are used especially for classifying course granular bulk materials such as mineral building materials, ores, etc. They are used in oscillating screen machines and consequently are exposed not only to rough operation but also to high dynamic stresses. In order to prevent wobbling of the screen linings, they are braced to the tension cables in the machine by means of connecting elements at the ends, in which case they rest on the crossbars running in the direction of the screen and have a camber in the middle.

These screen linings consist either of a wire cloth or more recently they are designed as plastic screens in which the tension cables are embedded in a castable plastic such as polyurethane. The tension cables project over the plastic wear layer at the sides and are secured to tension bars, etc., to which the tension forces acting on the machine are applied, by means of connecting elements.

Although plastic tension screens have better wear resistance and generate less noise in comparison with wire screens in many practical applications, they also have certain disadvantages. Since the entire screen surface is formed by a single screen lining, the entire screen must be replaced in the event of local wear or damage, so the lifetime is reduced and the investment cost is high accordingly. For the same reason, the screen lining must be manufactured in accordance with the given dimensions of the screen machine in the manufacturing operation and must be kept on stock there or by the operator of the screening machine. Furthermore, more rapid wear of the crossbars occurs at the contact points between the screen lining and the supporting crossbars where plastic is in contact with metal, while the plastic of the screen lining is relatively resistant. Consequently the crossbars must occasionally be serviced or even replaced and this is associated with a corresponding assembly expense.

SUMMARY OF THE INVENTION

This invention is based on the problem of improving a tension screen of the design described initially from a structural and functional standpoint and especially permitting a simple and inexpensive adaptation to the respective demand case.

This problem is solved according to this invention by the fact that the tension cables and the wear layer are structurally separate parts, the tension cables are sheathed in plastic and the wear layer is detachably connected to the tension cables.

Due to the structural separation of the tension cables and the wear layer and their detachable connection, it is possible to replace the wear layer in the event of damage or premature wear or just local wear while the tension cables remain in the screening machine. Conversely, if individual tension cables happen to fail, they can also be replaced without having to replace the wear layer. In order to prevent wear due to the relative movements and the resulting friction between the wear layer and the tension cables, the tension cables are sheathed in plastic. This sheathing increases the cross section of the tension cables so that large cross sections and areas for detachable joining of two parts are thus available.

Preferably, the wear layer of a screen surface consists of several plates of plastic that are detachably secured to the tension cables.

The foregoing and other objects, features and advantages of the invention will become more readily apparent from the following detailed description of a preferred embodiment which proceeds with reference to the drawings.

With the aforementioned design, it is possible to repair the screen surface which consists of several plastic plates by repairing just certain areas by replacing an individual plastic plate which has been rendered prematurely useless due to wear or other damage or by switching the feed side to the delivery side within the screen surface, for example. The mesh of the screen on the screen surface can also be adjusted to the prevailing use conditions with no problem by replacing individual plates.

In another preferred embodiment, the plastic sheathing of the tension cables forms a locking profile when seen in cross section and the wear layer has corresponding locking grooves on its lower side at a distance from the tension cable.

With this embodiment, an especially simple detachable connection between the plates and the tension cables is provided since the tension cables are first braced in the machine and then the plates are locked in place. In subsequent operation of the screening machine, it is possible to lift out and replace individual plates with no problem. The locking connection need be designed only in such a way that it can withstand the dynamic forces in operation so the corresponding back cuts on the locking grooves and corresponding projections on the sheathing of the tension cables provide adequate assurance.

According to another feature of this invention, the tension cables are in contact with a portion of their sheathing such as the base along the side facing the crossbars.

The sheathing on the tension cables together with the base also forms the necessary support surface for the crossbars so the screen linings are satisfactorily supported on the crossbars and can be excessively cambered. The sheathing is preferably flush with the lower side of the wear layer and seals it.

According to another embodiment, the tension cables with their sheathing may have alternating locking profiles over the entire length of the screen and the plate may have locking grooves of a corresponding cross section in a corresponding distribution.

The locking profiles and locking grooves may differ in cross section through different cambers and back cuts in order to yield a more stable locking connection between the plates and the tension cables area by area.

In order to obtain a satisfactory seal at the edges, the plates may have an indented step along the side edges running parallel with the direction of conveyance of the screened material so they rest on a corresponding step-shaped support on the connecting elements of the tension cables.

In order to permit satisfactory positioning of the tension cables which are provided with tension bars over the entire screen surface, another embodiment of this invention is characterized in that the tension cables are connected by at least one support strip in the middle across their extent and the plates each extend from a side support to a support strip.

The support strip distances the tension cables to a defined extent This makes it possible to satisfactorily connect the locking grooves arranged at an appropriate distance on the lower side of the plates with the tension cables. Furthermore the support strip makes it possible to divide the screen lining in the transverse direction and divide the wear layer into smaller replaceable plates, so a minimum of screen area must be replaced especially when there is local wear or local damage.

In an expedient design, the support strip may be a horizontal T section whose top belt at the bottom has a support for a step-shaped indented contact with the plate on both sides of the web. Thus the plate has an identical stepshaped design on both side edges so it can be mounted in any desired manner at any desired location in the screen area.

Preferably the support strip is without reinforcement and is designed in one piece with the plastic sheathing of the tension cables. The tension cables may be placed in a suitable casting mold for the sheathing and the support strip and then the mold filled with the molten plastic in order to sheath all the tension cables in one casting operation and at the same time form the support strip in one piece with the sheathing.

With the known tension screens, the connecting elements at the ends are each designed with a tension bar to which the tension cables are attached and which can be stretched against machine-mounted supports. The tension bar is designed with an angular or hook-shaped cross section and is pulled to the side by means of tension elements which are supported on machine-mounted supports. The attachment may be accomplished in various ways. For example, the tension cables have cable eye clips at the ends which are placed over appropriately grooved supports on the tension bars.

This invention provides for the tension bars, including the mounting points of the tension cable, to be coated with plastic and for this coating to have a strip-like thickened area extending along the length of the tension bars to form the support for the side edges of the plates.

In this way not only are the tension bar and the mounting points protected against wear and corrosion but also the sheathing covering them at the same time fulfills the function of a side support for the side edges of the screen linings.

As already indicated, this invention is characterized especially in that the plates forming the wear layer are made exclusively of plastic so they have no reinforcement.

The advantages in comparison with traditional tension screens have already been explained. However, this design also yields certain advantages in comparison with the known replaceable screens where individual plastic screen linings are inserted like grids between steel sections—although without any essential prestress. These screen linings must have an internal reinforcement in order to be able to withstand the forces that occur between the steel sections. In comparison with the plastic plates according to this invention, these replaceable screens are relatively expensive and furthermore the reinforcement which is usually still intact at the time of replacement also becomes a waste product together with the lining which has been rendered useless.

Preferably the plates, the sheathing of the tension cables, the support strip and the coating on the tension bars are all made of the same plastic, especially castable polyurethane.

The foregoing and other objects, features and advantages of the invention will become more readily apparent from the following detailed description of a preferred embodiment which proceeds with reference to the drawings.

BRIEF DESCRIPTION OF THE DRAWINGS

This invention is described in greater detail below with reference to practical embodiments which are illustrated in the figures which show the following.

DETAILED DESCRIPTION OF THE PREFERRED EMBODIMENT

Figure 1:
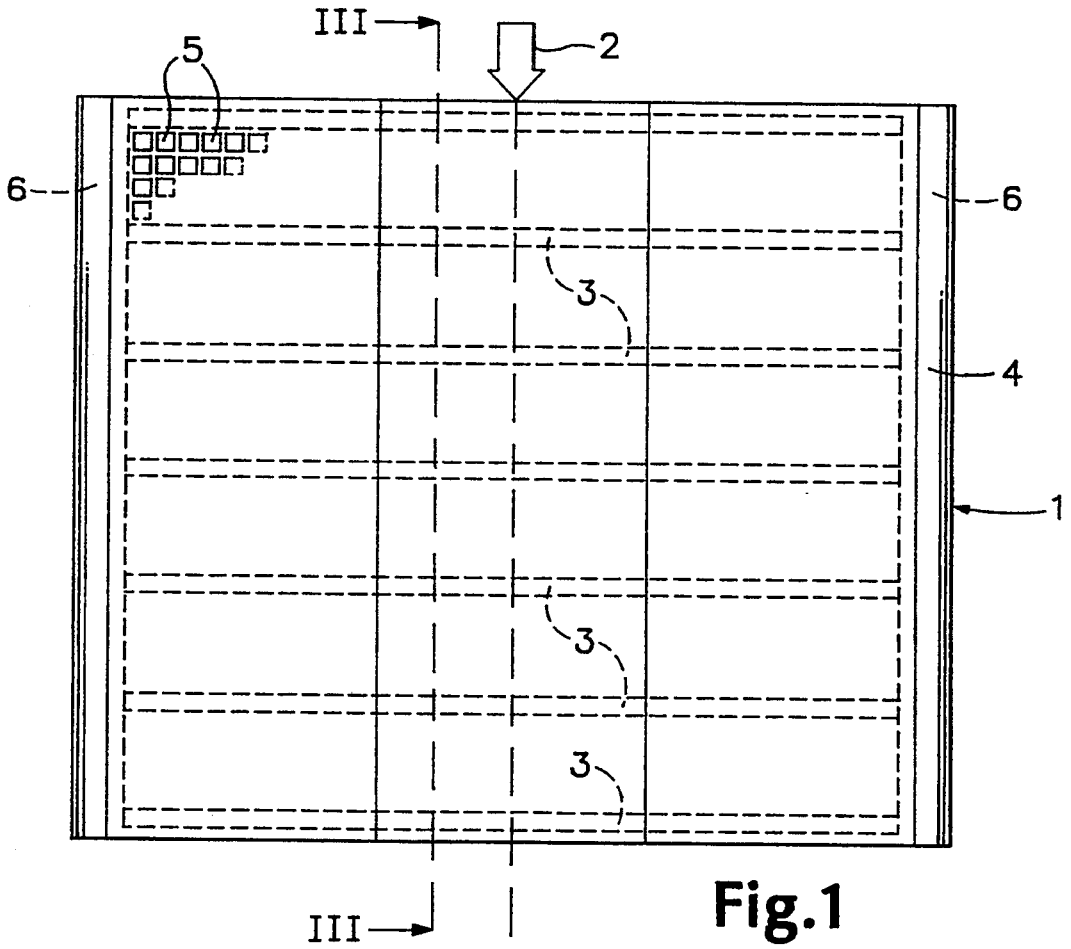
FIG. 1 shows a top view of the screen surface of a vibrating screening machine.
Figure 2:
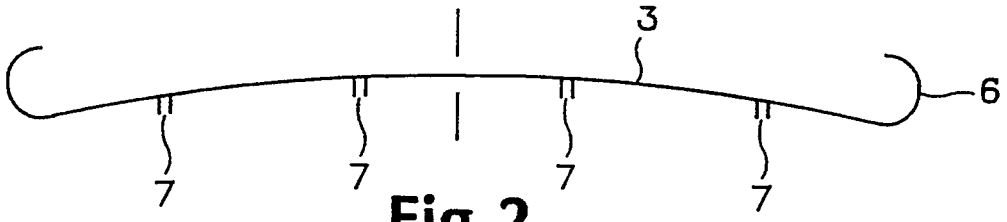
FIG. 2 shows a schematic diagram of the end of the screen surface in the direction of conveyance of the screened material.
Figure 3:
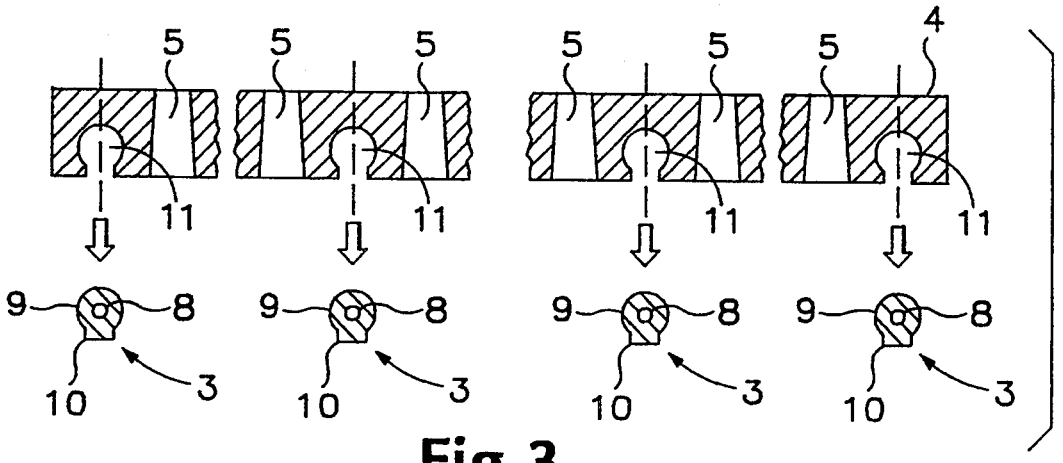
FIG. 3 shows section m–m according to FIG. 1 of a first embodiment of the screen lining.

The tension screen 1 shown in FIGS. 1 to 3 consists of tension cables 3 running across the direction of conveyance 2 of the screen material and parallel to each other and a wear layer 4 made of plastic covering the screen material on the top and provided with screen passages 5, as indicated only in areas in FIG. 1. All tension cables 3 are attached with both ends to tension bar 6 by means of which they can be secured inside the screening machine. As shown in FIG. 2, crossbars 7 running in the direction of conveyance 2 of the screened material are provided on the screening machine so the tension screen 1 is stretched over these crossbars with a camber in the middle. As FIG. 3 shows, the screen lining 1 consists of two parts that are structurally and functionally separate, namely first the tension cables 3 and secondly the plate-shaped wear layer 4 of a wear-resistant plastic with screen passages 5. The tension cables 3 consist of the wire cable 8 that absorbs the tension forces and forms the load-bearing core and a plastic sheathing 9 which in the embodiment shown here is designed as a locking profile with a partially cylindrical cross section. Sheathing 9 also has a strip-shaped base 10 on its lower side with which the tension cables are in contact with the machine-mounted crossbars 7 and lower side running over the entire length at a distance that corresponds to the tension cables 3, so the grooves have a locking profile that corresponds to the plastic sheathing 9 of the tension cables 3. Thus the plastic wear layer 4 can easily be locked onto the tension cables 3 mounted in the machine and can be replaced as needed.

Figure 4:
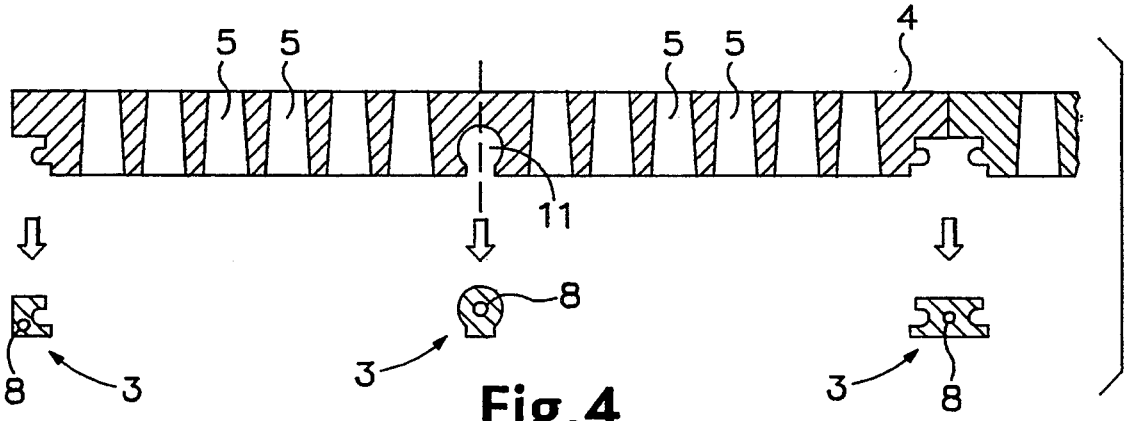
FIG. 4 shows a section like FIG. 3 of another embodiment of screen lining.

In the embodiment according to FIG. 4, a tension cable 3 with a locking profile corresponding to that in FIG. 3 is shown while tension cables 3 with a plastic sheathing forming different locking profiles are shown to the right and left. These locking profiles may be provided, for example, on one side edge of a wear layer as indicated at the left of FIG. 4 or at the transition between two wear layers as shown at the right.

Figure 5:
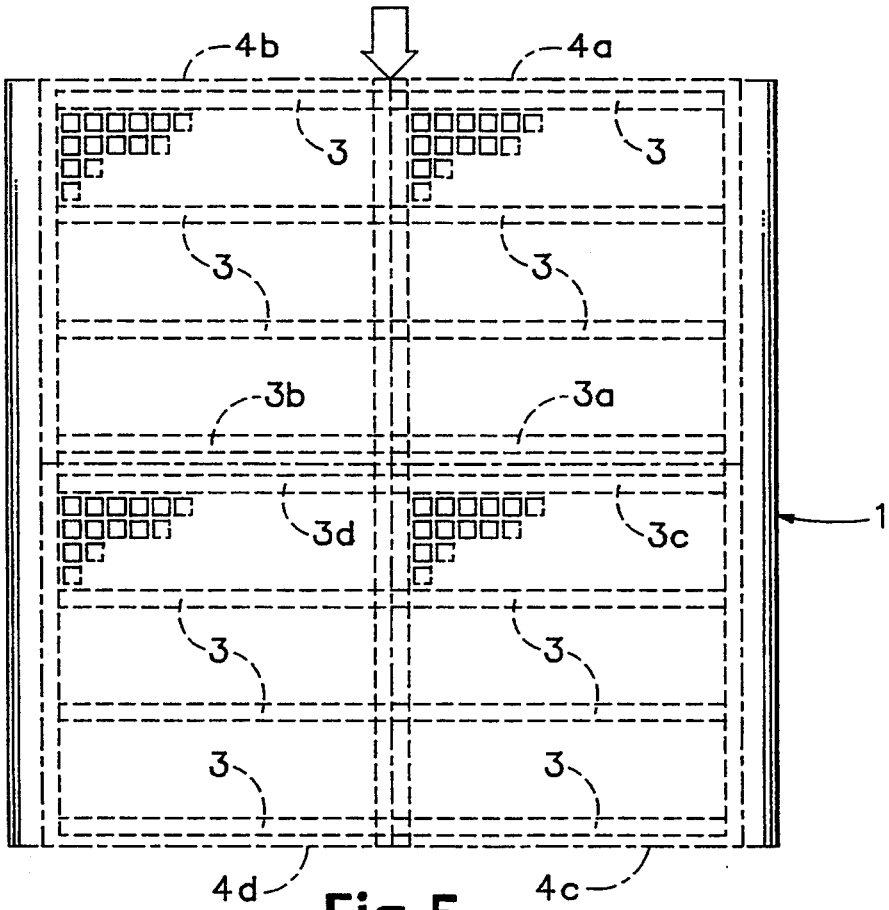
FIG. 5 shows the screen surface of a screening machine like the diagram in FIG. 1 in another modified design of the screen linings.
Figure 6:
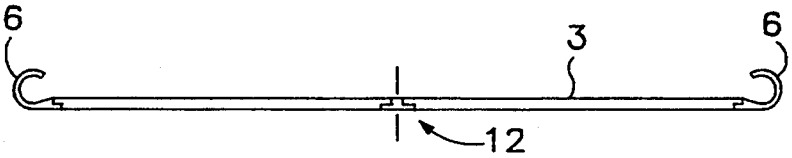
FIG. 6 shows an end view of a screen surface according to FIG. 5 without the screen lining.

FIG. 5 shows one embodiment whereby the tension screen 1 has a total of four plate-shaped wear layers 4*a*, *b*, *c* and d whose side borders are indicated by dash-dot lines. Tension cables 3 may essentially correspond to the design according to FIG. 1 but in the impact area of wear layers 4*a* and 4*c* on the one hand and wear layers 4*b* and 4*d* on the other hand, tension cables 3*a*, 3*c* and 3*b*, 3*d*, respectively, are set for a narrow distance in order to be able to satisfactorily support and brace the tension linings in the connecting area. Furthermore, in this design, tension cables 3 are connected by a support strip 12 which, as shown in FIG. 6, is cast in one piece with the plastic sheathing of tension cables 3. Support strip 12 has a horizontal T section whose crossbar forms a support for the plate-shaped wear layers 4 on both sides of the web, where the wear layers are retracted inward in a step shape for this purpose. The support strip, however, may also have the profile shown at the right of FIG. 4 (not including the wire core). The plate-shaped screen linings 4 also have corresponding steps 13 on their side edges close to tension bars 6 as shown in FIG. 7, where they rest on a support 14 formed on tension bars 6.

Tension bars 6 have a metal section 15, for example, in the shape of a hook to which the wire cable 8 of tension cables 3 is attached. For example, the wire cables 8 may have cable eye clips on their ends by means of which they are placed over a roll-like support which is welded to the inside of the metal section 15. Metal section 15 and the attachment of the wire cables 8 to the metal section are sheathed in plastic 17 which has a stripshaped thickened area 18 in the area of the attachment point 6, where they form the support 14 for step 13 of the plate-shaped wear layer 4.

Figure 7:
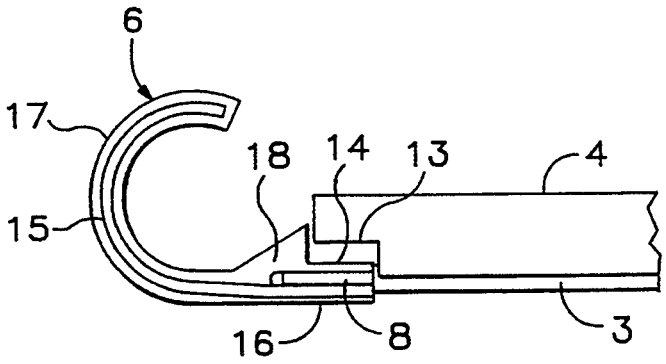
FIG. 7 shows an enlarged detail in the area of the connecting elements.
Figure 8:
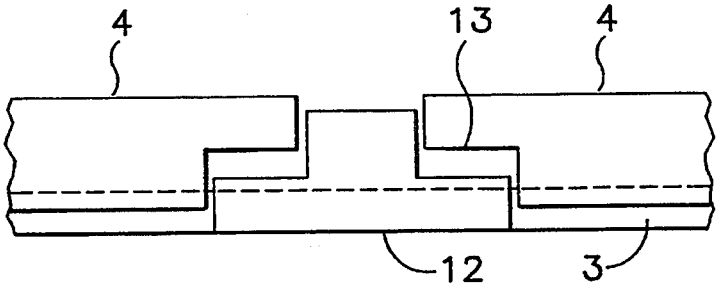
FIG. 8 shows an enlarged detail in the area of the supporting strip.
Figure 9:
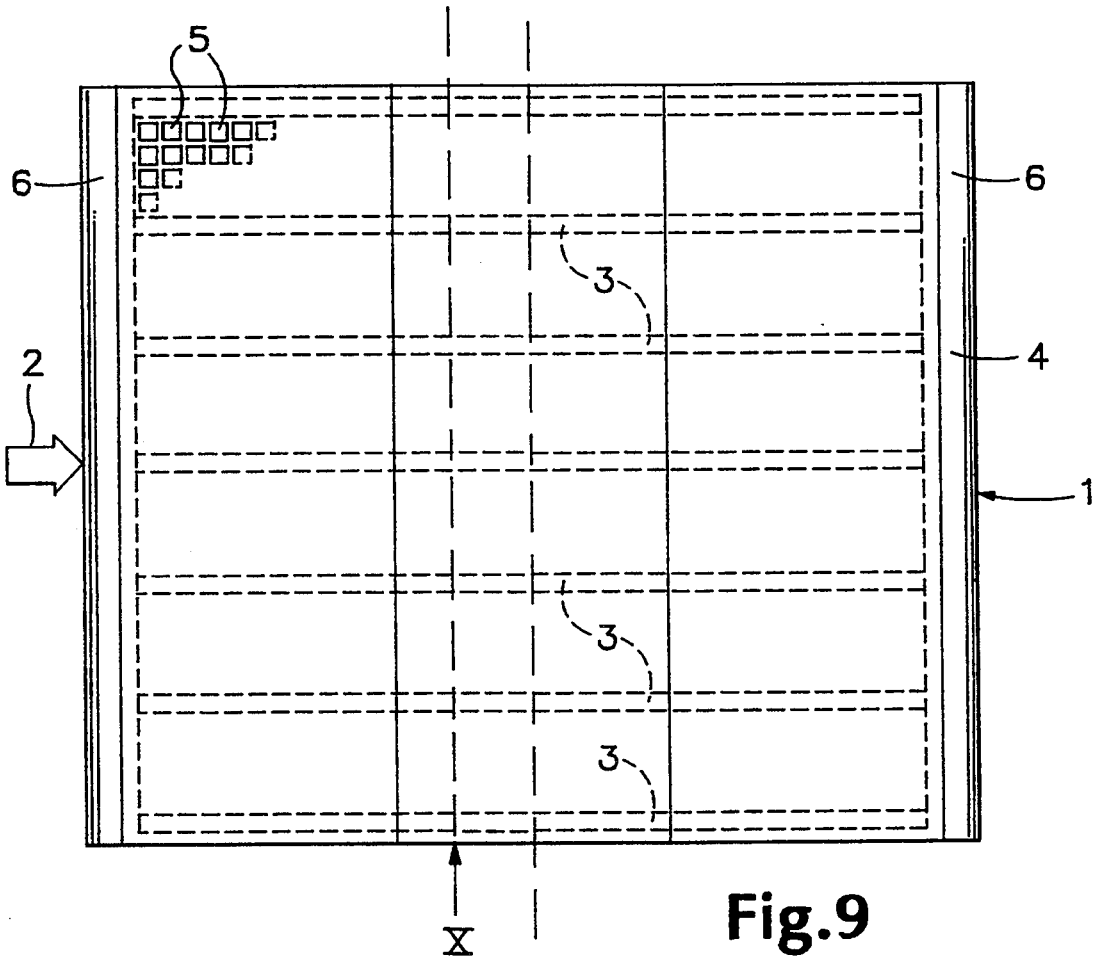
FIG. 9 shows a view of a screen lining corresponding to FIG. 1 in a different arrangement.

In FIG. 8, which like FIG. 7 illustrates a phase during the locking of the plates of wear layer 4 onto the tension cables 3, the area of the supporting strip 12 is shown in greater detail, where the individual plates with step 13 come to lie in the end position on the crossbar of the T section of the supporting strip 12.

Figure 10:
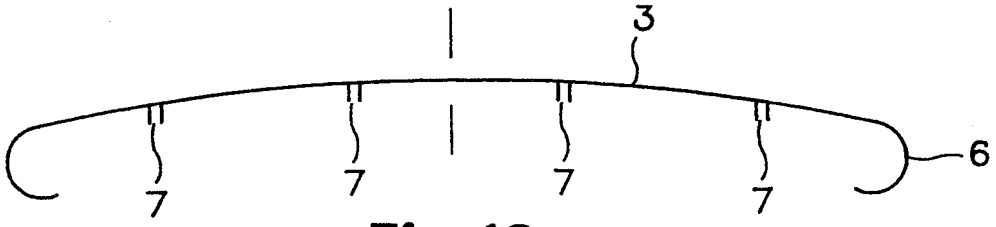
FIG. 10 shows a side view according to the arrow X in FIG. 9.

FIG. 10 shows a different design of a tension screen 1, whereby the machine-mounted crossbars 7 are arranged across the direction of conveyance 2 of the screened material and the tension cables 3 are under tension in the direction of conveyance. Tension bars 6 are braced on the machine at the feed point and discharged for the screened material in this case and therefore the tension bats are bent downward as shown in FIG. 10. In this embodiment, wear layer 4 consists of three plates arranged across the direction of conveyance 2. In this case the plate may also be joined together at their abutting edges by locking profile molded on them.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A tension screening apparatus for a screening machine comprising a screening surface formed of screen elements on reinforcing members, said screen elements having an outer wear-resistant surface layer; screen passages and tension cables disposed across the reinforcing members and braced on the screening machine by means of connecting elements at their ends; the tension cables and the wear-resistant layer being formed as structurally distinct elements, the tension cables including an outer protective sheathing, the wear-resistant layer being detachably joined to the tension cables, and the outer protective sheathing having a base which is flush with the underneath side of said wear-resistant layer thereby sealing said wear-resistant layer.

2. The apparatus of claim 1, wherein said screening elements are stretched over said reinforcing members.

3. The apparatus of claim 1, wherein said screening elements have a camber.

4. The apparatus of claim 1, wherein said reinforcing members comprise crossbars.

5. The apparatus of claim 1, wherein said wear layer is fabricated of a plastic wear material.

6. The apparatus of claim 1, wherein the cross-sectional portion of said outer protective sheathing surrounding the tension cables forms a locking profile, and the wear-resistant layer has locking grooves which are complementary with the locking profile.

7. The apparatus of claim 1, wherein said wear layer-resistant layer is formed of a plurality of sections which are attachable to, and detachable from, the tension cables.

8. The apparatus of claim 7, wherein the cross-sectional portion of said outer protective sheathing surrounding the tension cables forms a locking profile, and the plurality of sections of the wear-resistant layer have locking grooves which are complementary with the locking profile.

9. The apparatus of claim 1, wherein the tension cables are in direct contact with the reinforcing members along a portion of the outer protective sheathing.

10. The apparatus of claim 1, wherein the outer protective sheathing of the tension cables includes a base on the side facing the reinforcing members and is in surface contact therewith.

11. The apparatus of claim 7, wherein the tension cables include locking profiles that are alternately spaced with the outer protective sheathing over the entire screen length and each of the sections has a cross-sectional configuration that corresponds to locking grooves in a corresponding wear-resistant layer.

12. The apparatus of claim 7, wherein the sections have an indented step on the side edges parallel to the direction of conveyance of the screened material, and the sections being in contact with complementary step-shaped supports on connecting means attached to the tension cables.

13. The apparatus of claim 7, wherein the tension cables are connected to at least one support strip, and the sections each extend from a side support to the support strip.

14. The apparatus of claim 13, wherein the support strip comprises a horizontal T-section whose reinforcing member has a support for a step-shaped support on the sections.

15. The apparatus of claim 13, wherein the support strip is designed so it has no reinforcement and is made in one piece in combination with the outer protective sheathing.

16. The apparatus of claim 1, wherein the connecting elements at the ends of each tension bar to which the tension cables are attached include mounting members joined to the tension cables which are coated with a plastic material.

17. The apparatus of claim 16, wherein the .coating has a strip of a thickened area extending along the length of the tension bar forming the support for the sections.

18. The apparatus of claim 7, wherein the sections that form the wear-resistant layer are formed without any reinforcement.

19. A tension screening apparatus for a screening machine comprising a screening surface formed of screen elements on reinforcing members, said screen elements having an outer wear-resistant surface layer; screen passages and tension cables disposed across the reinforcing members and braced on the screening machine by means of connecting elements at their ends; the tension cables and the wear-resistant layer being formed as structurally distinct elements, the tension cables including an outer protective sheathing and a wire cable that absorbs tension forces and forms a load bearing core, the wear-resistant layer being detachably joined to the tension cables, and the wire cable being located within the confines of the screen elements.

20. The apparatus of claim 19, wherein said screening elements are stretched over said reinforcing members.

21. The apparatus of claim 19, wherein said screening elements have a camber.

22. The apparatus of claim 19, wherein said reinforcing members comprise crossbars.

23. The apparatus of claim 19, wherein said wear layer is fabricated of a plastic wear material.

24. The apparatus of claim 19, wherein the cross-sectional portion of said outer protective sheathing surrounding the tension cables forms a locking profile, and the wear-resistant layer has locking grooves which are complementary with the locking profile.

25. The apparatus of claim 19, wherein the tension cables are in direct contact with the reinforcing members along a portion of the outer protective sheathing.

26. The apparatus of claim 19, wherein the outer protective sheathing of the tension cables includes a base on the side facing the reinforcing members and is in surface contact therewith.

* * * * *